US011170714B2

(12) United States Patent
Hu et al.

(10) Patent No.: US 11,170,714 B2
(45) Date of Patent: Nov. 9, 2021

(54) PIXEL CIRCUIT, METHOD FOR DRIVING THE SAME, DISPLAY PANEL AND DISPLAY DEVICE

(71) Applicants: Chengdu BOE Optoelectronics Technology Co., Ltd., Chengdu (CN); BOE Technology Group Co., Ltd., Beijing (CN)

(72) Inventors: Sheng Hu, Beijing (CN); Ziyang Yu, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/001,737

(22) Filed: Aug. 25, 2020

(65) Prior Publication Data

US 2021/0074211 A1 Mar. 11, 2021

(30) Foreign Application Priority Data

Sep. 5, 2019 (CN) ..... 201910836923.3

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01)

(58) Field of Classification Search
CPC ..... G09G 3/3233; G09G 2300/0426; G09G 2300/0852; G09G 2310/0216; G09G 2320/0233; G09G 2320/045
See application file for complete search history.

(56) References Cited

U.S. PATENT DOCUMENTS

2016/0189635 A1 6/2016 Lee et al.
2017/0256205 A1* 9/2017 Zhu ..... G09G 3/3233
2018/0374419 A1 12/2018 Chen et al.

FOREIGN PATENT DOCUMENTS

CN 104409042 A 3/2015
CN 106920508 A 7/2017
CN 108364610 A 8/2018

OTHER PUBLICATIONS

Office Action for corresponding Chinese Application 201910836923.3 dated Jun. 24, 2020.

(Continued)

*Primary Examiner* — Stacy Khoo
(74) *Attorney, Agent, or Firm* — Arent Fox LLP; Michael Fainberg

(57) ABSTRACT

The present disclosure discloses a pixel circuit, a method for driving the same, a display panel and a display device. The pixel circuit includes: a first switching transistor, a second switching transistor, a first capacitor, a second capacitor, a driving transistor, and a light emitting device; where a gate electrode of the first switching transistor is connected with a scanning signal end, a first electrode of the first switching transistor is connected with a reference signal end, and a second electrode of the first switching transistor is connected with a gate electrode of the driving transistor; and a gate electrode of the second switching transistor is connected with a light emitting control signal end, a first electrode of the second switching transistor is connected with a first power supply end, and a second electrode of the second switching transistor is connected with a first electrode of the driving transistor.

10 Claims, 8 Drawing Sheets

(56) References Cited

OTHER PUBLICATIONS

Office Action for corresponding Chinese Application 201910836923.3 dated Sep. 22, 2020.
Decision of Rejection for corresponding Chinese Application 201910836923.3 dated Dec. 22, 2020.

* cited by examiner

PIXEL CIRCUIT, METHOD FOR DRIVING THE SAME, DISPLAY PANEL AND DISPLAY DEVICE

The present disclosure claims the priority from Chinese Patent Application No. 201910836923.3, filed with the Chinese Patent Office on Sep. 5, 2019, and entitled "PIXEL CIRCUIT, METHOD FOR DRIVING THE SAME, DISPLAY PANEL AND DISPLAY DEVICE", which is hereby incorporated by reference in its entirety.

FIELD

The present disclosure relates to the technical field of display, and in particular to a pixel circuit, a method for driving the same, a display panel and a display device.

BACKGROUND

An organic light emitting diode (OLED) is one of hotspots in the field of research of flat panel displays nowadays, and compared with a liquid crystal display (LCD), an OLED display has the advantages such as low energy consumption, low production cost, self-illumination, wide viewing angle and high response speed. At present, the OLED display has begun to replace a traditional LCD display in the field of displays such as a mobile phone, a tablet personal computer and a digital camera.

With the development of economy, customers have put forward a higher requirement for the quality of an electronic product, while there is also a higher expectation for a display screen serving as a human-computer interaction window. In order to achieve better visual experience, a frame displayed by a display is required to be delicate enough, which requires that the resolution ratio of the display screen reaches a higher level, while the number of pixels within the same area is also greatly increased with the increment of the resolution ratio, which requires that the area of single pixel is further reduced. The OLED is a current-driven device, an approximately linear corresponding relationship exists between the light emitting brightness of the OLED and a current density, and therefore, a driving current is required to be accordingly reduced to reach the same current density after the area of the pixel is reduced, in this way, there is a higher requirement for the precision control of a driving circuit of the OLED. Meanwhile, in order to reduce influences of change of a threshold voltage Vth caused by a production process on an output current of the driving circuit, the driving circuit is also required to have a Vth compensation function.

SUMMARY

Embodiments of the present disclosure provide a pixel circuit, a method for driving the same, a display panel and a display device. The pixel circuit includes a first switching transistor, a second switching transistor, a first capacitor, a second capacitor, a driving transistor and a light emitting device;

wherein a gate electrode of the first switching transistor is connected with a scanning signal end, a first electrode of the first switching transistor is connected with a reference signal end, and a second electrode of the first switching transistor is connected with a gate electrode of the driving transistor;

a gate electrode of the second switching transistor is connected with a light emitting control signal end, a first electrode of the second switching transistor is connected with a first power supply end, and a second electrode of the second switching transistor is connected with a first electrode of the driving transistor;

a first end of the first capacitor is connected with a data signal end, and a second end of the first capacitor is connected with a second electrode of the driving transistor;

a first end of the second capacitor is connected with the gate electrode of the driving transistor, and a second end of the second capacitor is connected with the second electrode of the driving transistor; and an anode of the light emitting device is connected with the second electrode of the driving transistor, and a cathode of the light emitting device is connected with a second power supply end.

In some embodiments, in the above-mentioned pixel circuit according to the embodiment of the present disclosure, a capacitance value of the second capacitor is greater than that of the first capacitor.

In some embodiments, in the above-mentioned pixel circuit according to the embodiment of the present disclosure, each of the first switching transistor, the second switching transistor and the driving transistor is an N-type transistor.

Accordingly, an embodiment of the present disclosure further provides a display panel including any one of the above-mentioned pixel circuit according to the embodiment of the present disclosure.

Accordingly, an embodiment of the present disclosure further provides a display device including the above-mentioned display panel according to the embodiment of the present disclosure.

Accordingly, an embodiment of the present disclosure further provides a method for driving any one of the above-mentioned pixel circuit according to the embodiment of the present disclosure, including:

in a compensation phase: turning on the first switching transistor by the scanning signal end, and loading a low-potential signal to the gate electrode of the driving transistor by the reference signal end; and turning on the second switching transistor by the light emitting control signal end, and loading a high-potential signal to the first electrode of the driving transistor by the first power supply end;

in a data writing phase: turning on the first switching transistor by the scanning signal end, and loading a high-potential signal to the gate electrode of the driving transistor by the reference signal end; turning off the second switching transistor by the light emitting control signal end; and loading a data signal to the second electrode of the driving transistor by the data signal end; and in a light emitting phase: turning off the first switching transistor by the scanning signal end; and turning on the second switching transistor by the light emitting control signal end, and loading the high-potential signal to the first electrode of the driving transistor by the first power supply end, for controlling the driving transistor to drive the light emitting device to emit light.

In some embodiments, in the above-mentioned method according to the embodiment of the present disclosure, in the data writing phase, time of turning off the first switching transistor by the scanning signal end is earlier than that of stopping loading the data signal by the data signal end.

In some embodiments, in the above-mentioned method according to the embodiment of the present disclosure, in the data writing phase, time of stopping loading the high-potential signal by the reference signal end is later than that of turning off the first switching transistor by the scanning signal end.

In some embodiments, in the above-mentioned method according to the embodiment of the present disclosure, in the data writing phase, time of stopping loading the high-potential signal by the reference signal end is later than that of stopping loading the data signal by the data signal end.

In some embodiments, in the above-mentioned method according to the embodiment of the present disclosure, before the compensation phase, the method further includes:

in an initialization phase: turning on the first switching transistor by the scanning signal end, and loading the low-potential signal to the gate electrode of the driving transistor by the reference signal end; and turning on the second switching transistor by the light emitting control signal end, and loading the low-potential signal to the first electrode of the driving transistor by the first power supply end.

DETAILED DESCRIPTION OF THE EMBODIMENTS

In order to make objectives, technical solutions and advantages of the present disclosure clearer, detailed descriptions of a pixel circuit, a method for driving the same, a display panel and a display device according to embodiments of the present disclosure are explained in detail below in combination with the accompanying drawings.

With the increment of the resolution ratio of the display, the area of single pixel circuit is also reduced, and therefore, the structure of the driving circuit is required to be simple as much as possible during the design of the driving circuit to lower the difficulty during Layout design. The driving circuit of the OLED is divided into an negative channel metal oxide semiconductor (NMOS) and a positive channel metal oxide semiconductor (PMOS) according to used different thin film transistor (TFT) types, a source electrode of the NMOS is generally located at an anode end during an actual application, and therefore, an accompanying source structure is generally adopted to guarantee the current stability after a TFT is started. However, due to the adoption of the structure, the threshold voltage Vth may not be completely compensated under the influence of a capacitive coupling effect in a compensation phase, and thus, the display effect of a panel may be affected to a certain extent. Meanwhile, since the sub-threshold of the NMOS is relatively small, a data voltage signal of the pixel circuit is required to have higher precision to realize more precise current control, in this way, there is a higher requirement for the driving capability of an integrated circuit (IC), and therefore, designing the pixel circuit to achieve higher precision of the data voltage signal has certain application value.

Figure 1:
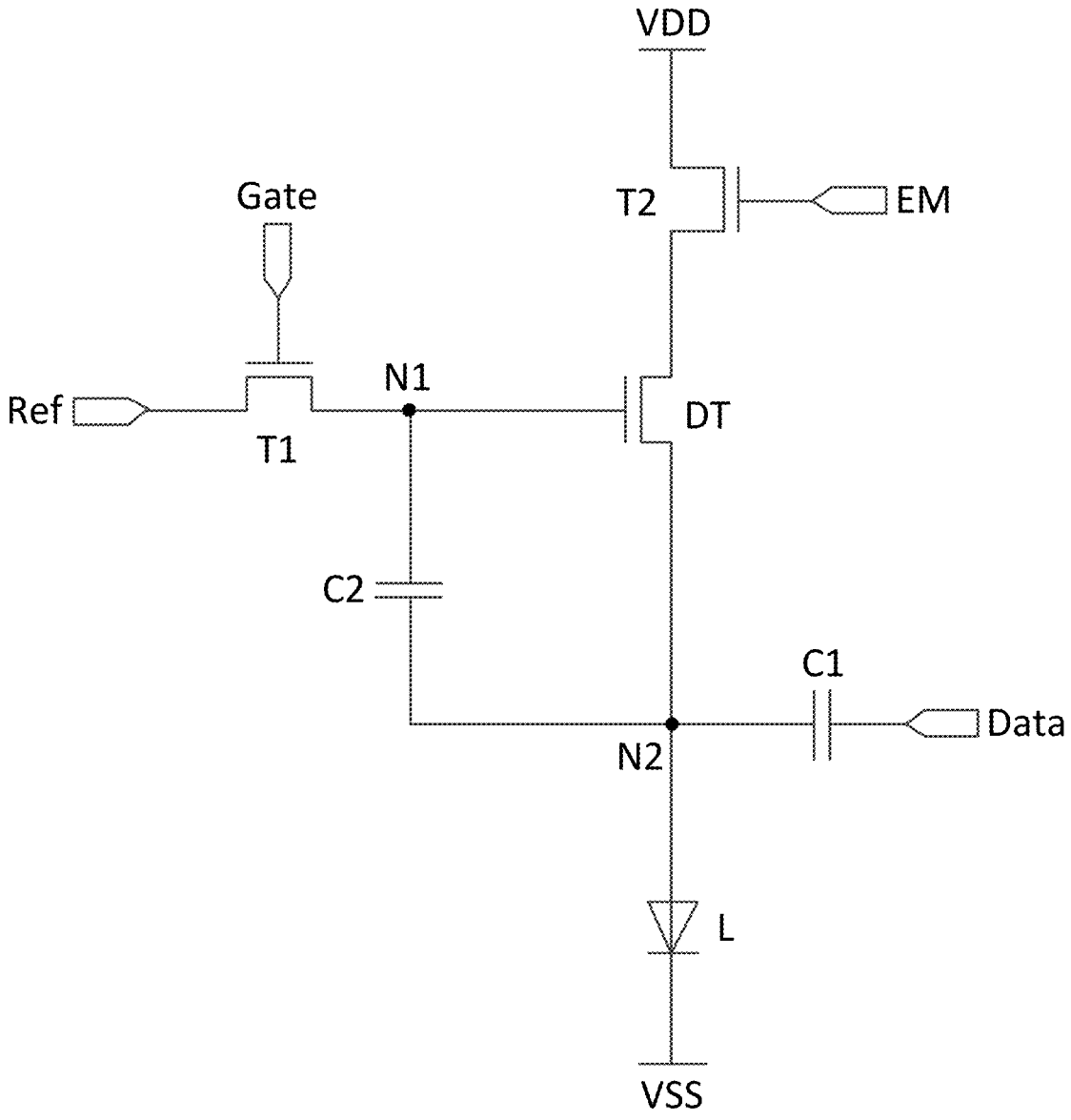
FIG. 1 is a first schematic structural diagram of a pixel circuit according to an embodiment of the present disclosure.

An embodiment of the present disclosure provides a pixel circuit, as shown in FIG. 1, including a first switching transistor T1, a second switching transistor T2, a first capacitor C1, a second capacitor C2, a driving transistor DT and a light emitting device L.

Agate electrode of the first switching transistor T1 is connected with a scanning signal end Gate, a first electrode of the first switching transistor T1 is connected with a reference signal end Ref, and a second electrode of the first switching transistor T1 is connected with a gate electrode of the driving transistor DT; in some embodiments, when the first switching transistor T1 is in a turned-on state under control of the scanning signal end Gate, a reference signal of the reference signal end Ref is provided for the gate electrode (N1 point) of the driving transistor DT.

A gate electrode of the second switching transistor T2 is connected with a light emitting control signal end EM, a first electrode of the second switching transistor T2 is connected with a first power supply end VDD, and a second electrode of the second switching transistor T2 is connected with a first electrode of the driving transistor DT; in some embodiments, when the second switching transistor T2 is in a turned-on state under control of the light emitting control signal end EM, a voltage of the first power supply end VDD is provided for the first electrode of the driving transistor DT, and a driving current output by a second electrode of the driving transistor DT is output to the light emitting device L to drive the light emitting device L to emit light.

A first end of the first capacitor C1 is connected with a data signal end Data, and a second end of the first capacitor C1 is connected with the second electrode of the driving transistor DT; in some embodiments, the data signal end Data inputs a data signal to the second electrode of the driving transistor DT through the first capacitor C1.

A first end of the second capacitor C2 is connected with the gate electrode of the driving transistor DT, and a second end of the second capacitor C2 is connected with the second electrode of the driving transistor DT; in some embodiments, the second capacitor C2 is charged under joint control of a gate electrode (N1 point) signal of the driving transistor DT and a second electrode signal of the driving transistor DT, and the second capacitor C2 is discharged under joint control of the gate electrode (N1 point) signal of the driving transistor DT and the second electrode signal of the driving transistor DT; when the light emitting device L is in a light emitting state, a voltage difference of the gate electrode (N1 point) of the driving transistor DT and the second electrode of the driving transistor DT is kept stable, so as to ensure that the driving transistor DT outputs a stable current.

An anode of the light emitting device L is connected with the second electrode of the driving transistor DT, and a cathode of the light emitting device L is connected with a second power supply end VSS.

According to the above-mentioned pixel circuit according to the embodiment of the present disclosure, by coordination of the above-mentioned three transistors and two capacitors, an input range of a data voltage of the data signal end may be extended, the extended range is related to capacitance values of the two capacitors, and therefore, the pixel circuit according to the present disclosure may extend the input range of the data voltage on the basis that driving capability of a driving IC is not improved, namely the data voltage may have a wider input range on the basis that a cost is not increased, so that higher-precision current control is realized, and precision of a display frame is improved. In addition, by coordination of the above-mentioned three transistors and two capacitors, the current output by the driving transistor in the pixel circuit may also be only related to the data voltage of the data signal end and a reference voltage of the reference signal end, but is unrelated to a threshold voltage of the driving transistor, in this way, influences of the threshold voltage of the driving transistor on the current output by the driving transistor may be avoided, so that the current output by the driving transistor may be kept stable, and furthermore, brightness uniformity of a frame in a display area in a display device may be improved.

In some embodiments, in the above-mentioned pixel circuit according to the embodiment of the present disclosure, the second capacitor has to keep the voltage difference of the gate electrode of the driving transistor and the second electrode of the driving transistor stable for a long time to ensure that the current flowing towards the light emitting device is constant, and therefore, the capacitance value of the second capacitor is relatively large. In order to reduce an area occupied by a space and guarantee design feasibility of the pixel circuit, the capacitance value of the first capacitor is relatively small. Therefore, in some embodiments, in the above-mentioned pixel circuit according to the embodiment of the present disclosure, the capacitance value of the second capacitor is greater than that of the first capacitor.

Further, in some embodiments, in the above-mentioned pixel circuit according to the embodiment of the present disclosure, as shown in FIG. 1, each of the first switching transistor T1, the second switching transistor T2 and the driving transistor DT is an N-type transistor.

In some embodiments, in the above-mentioned pixel circuit according to the embodiment of the present disclosure, the N-type transistors are turned on under an action of a high potential and are turned off under an action of a low potential.

In some embodiments, in the above-mentioned pixel circuit according to the embodiment of the present disclosure, the light emitting device is generally an OLED, and the light emitting device emits light under an action of a current of the driving transistor in a saturated state. In addition, generally, the light emitting device has a threshold voltage, and the light emitting device emits light when voltages at two ends of the light emitting device are greater than or equal to the threshold voltage.

In some embodiments, in the above-mentioned pixel circuit according to the embodiment of the present disclosure, the voltage of the first power supply end VDD is generally a high-level voltage, and a voltage of the second power supply end VSS is generally grounded or is a low-level voltage.

It should be explained that, in the above-mentioned pixel circuit according to the embodiment of the present disclosure, each of the driving transistor and the switching transistors may be a TFT or a metal oxide semiconductor (MOS), limitations thereof are omitted herein.

In some embodiments, functions of the first electrodes and second electrodes of these switching transistors may be exchanged according to different types of the switching transistors and different signals of the signal ends, wherein the first electrodes may be source electrodes, the second electrodes may be drain electrodes, or the first electrodes may be the drain electrodes, the second electrodes may be the source electrodes, specific differentiations thereof are omitted herein.

Figure 2:
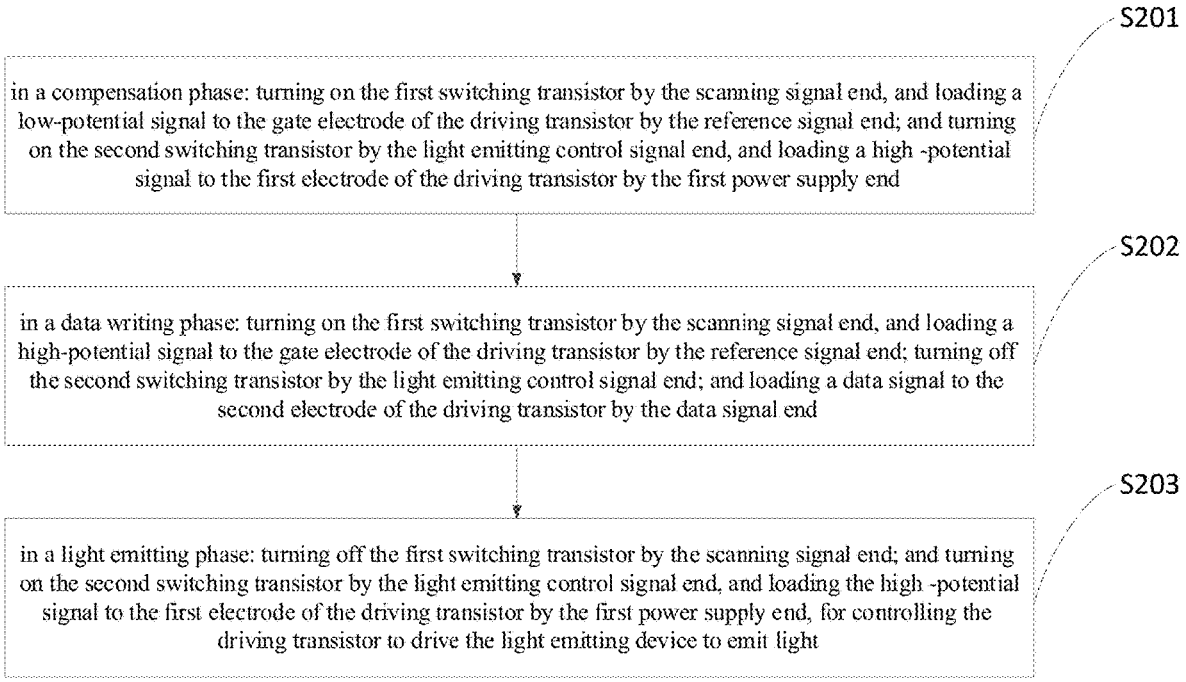
FIG. 2 is a first schematic flow diagram of a method for driving the pixel circuit, according to an embodiment of the present disclosure.

Based on the same inventive concept, an embodiment of the present disclosure further provides a method for driving any one of the above-mentioned pixel circuit according to the embodiment of the present disclosure, as shown in FIG. 2, and the method includes.

S201, in a compensation phase: turning on the first switching transistor by the scanning signal end, and loading a low-potential signal to the gate electrode of the driving transistor by the reference signal end; and turning on the second switching transistor by the light emitting control signal end, and loading a high-potential signal to the first electrode of the driving transistor by the first power supply end.

S202, in a data writing phase: turning on the first switching transistor by the scanning signal end, and loading a high-potential signal to the gate electrode of the driving transistor by the reference signal end; turning off the second switching transistor by the light emitting control signal end; and loading a data signal to the second electrode of the driving transistor by the data signal end.

S203, in a light emitting phase: turning off the first switching transistor by the scanning signal end; and turning on the second switching transistor by the light emitting control signal end, and loading the high-potential signal to the first electrode of the driving transistor by the first power supply end, for controlling the driving transistor to drive the light emitting device to emit light.

According to the method for driving the above-mentioned pixel circuit according to the embodiment of the present disclosure, an input range of a data voltage of the data signal end may be extended, the extended range is related to capacitance values of the two capacitors, and therefore, the pixel circuit according to the present disclosure may extend the input range of the data voltage on the basis that driving capability of a driving IC is not improved, namely the data voltage may have a wider input range on the basis that a cost is not increased, so that higher-precision current control is realized, and precision of a display frame is improved. In addition, a current output by the driving transistor in the pixel circuit may also be only related to the data voltage of the data signal end and a reference voltage of the reference signal end, but is unrelated to a threshold voltage of the driving transistor, in this way, influences of the threshold voltage of the driving transistor on the current output by the driving transistor may be avoided, so that the current output by the driving transistor may be kept stable, and furthermore, brightness uniformity of a frame in a display area in a display device may be improved.

Figure 3:
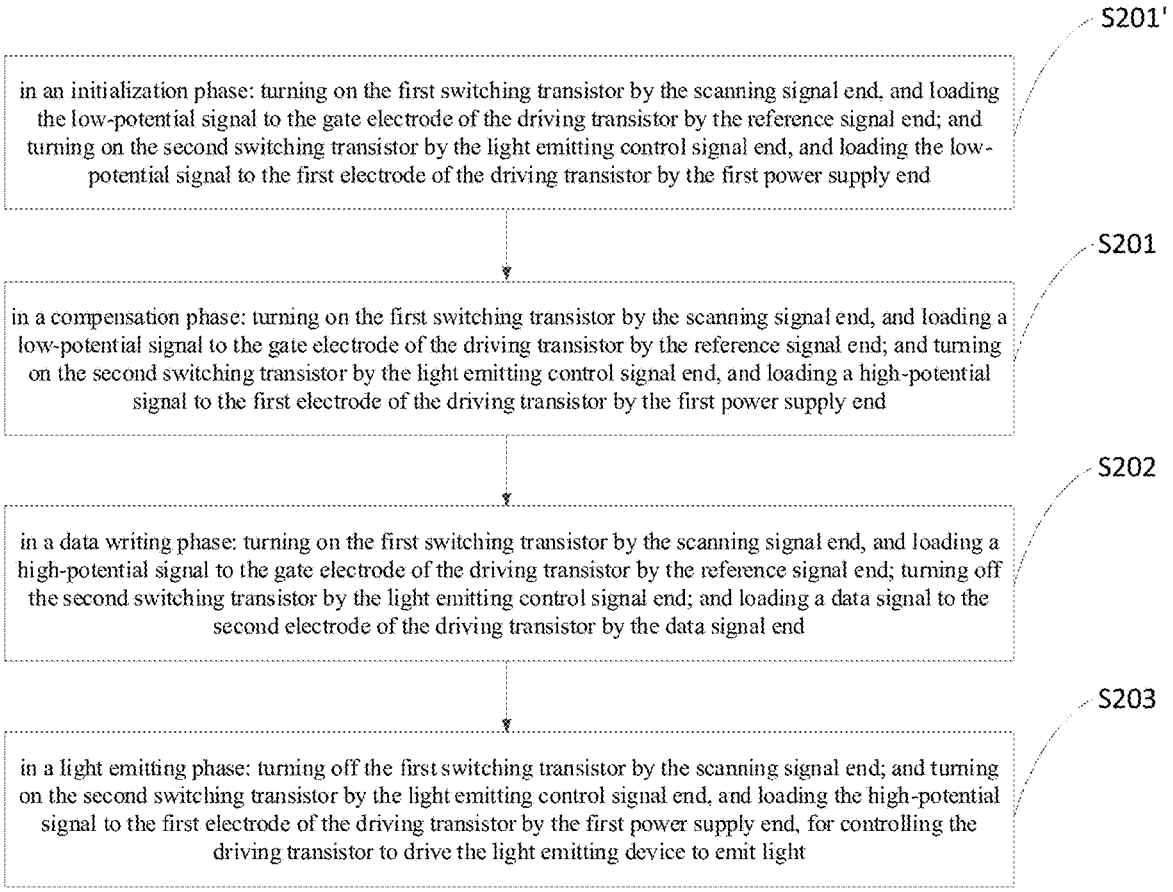
FIG. 3 is a second schematic flow diagram of the method for driving the pixel circuit, according to the embodiment of the present disclosure.

Further, in some embodiments, in order to prevent a signal of a last frame from affecting a signal of a next frame, in the above-mentioned method according to the embodiment of the present disclosure, as shown in FIG. 3, before the compensation phase of each frame, the method further includes.

S201', in an initialization phase: turning on the first switching transistor by the scanning signal end, and loading the low-potential signal to the gate electrode of the driving transistor by the reference signal end; and turning on the second switching transistor by the light emitting control signal end, and loading the low-potential signal to the first electrode of the driving transistor by the first power supply end.

Figure 4:
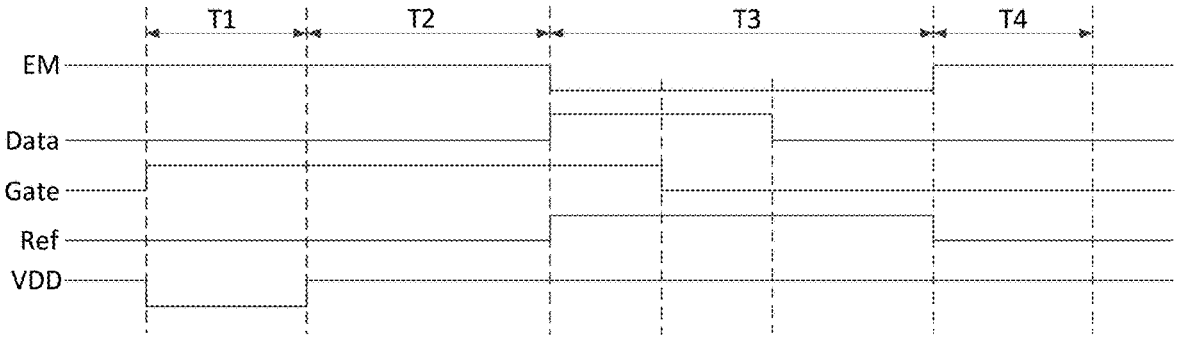
FIG. 4 is a schematic diagram of a circuit time sequence of the pixel circuit as shown in FIG. 1.

Further, in some embodiments, in the above-mentioned method according to the embodiment of the present disclosure, as shown in FIG. 4, in the data writing phase T3: the time of turning off the first switching transistor T1 by the scanning signal end Gate is earlier than that of stopping loading the data signal by the data signal end Data. Thus, it may be ensured that the data signal of the data signal end Data may be loaded to the second electrode of the driving transistor DT.

Further, in some embodiments, in the above-mentioned method according to the embodiment of the present disclosure, as shown in FIG. 4, in the data writing phase T3: the time of stopping loading the high-potential signal by the reference signal end Ref is later than that of turning off the first switching transistor T1 by the scanning signal end Gate.

Further, in some embodiments, in the above-mentioned method according to the embodiment of the present disclosure, as shown in FIG. 4, in the data writing phase T3: the time of stopping loading the high-potential signal by the reference signal end Ref is later than that of stopping loading the data signal by the data signal end Data.

Of course, in some embodiments, in the above-mentioned method according to the embodiment of the present disclosure, the time of stopping loading the high-potential signal by the reference signal end Ref may also be same as that of turning off the first switching transistor T1 by the scanning signal end Gate.

A working process of the above-mentioned pixel circuit according to the embodiment of the present disclosure is described below with the pixel circuit as shown in FIG. 1 as an example in combination with a circuit time sequence diagram. In the following description, 1 represents for a high potential, and 0 represents for a low potential. It should be noted that 1 and 0 are logic potentials and are merely intended to better explain the specific working process of the embodiment of the present disclosure, rather than a potential applied to the gate electrode of each of the switching transistors during specific implementation.

As shown in FIG. 1, the driving transistor DT is an N-type transistor, and both the switching transistors are N-type transistors; and corresponding input time sequence diagrams are shown in FIG. 4. Specifically, four phases including an initialization phase T1, a compensation phase T2, a data writing phase T3 and a light emitting phase T4 in the input time sequence diagram as shown in FIG. 4 are selected.

In the initialization phase T1, EM=1, Gate=1, Data=0, Ref=0 and VDD=0.

Figure 5:
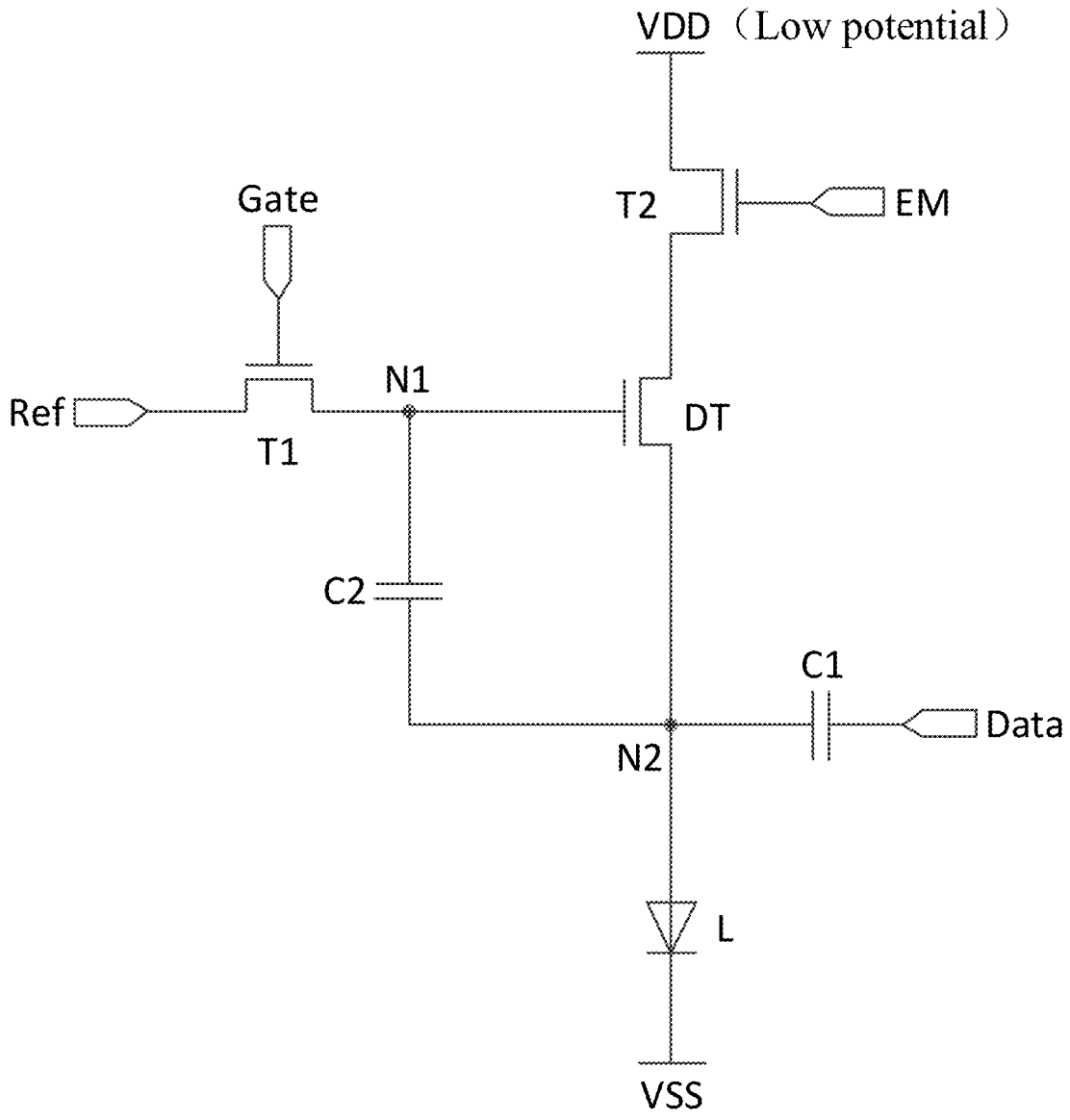
FIG. 5 is a schematic structural diagram of the pixel circuit as shown in FIG. 1 in an initialization phase.

As shown in FIG. 5, illustrating a schematic diagram of a working condition of the initialization phase of the pixel circuit of the present disclosure, all the first switching transistor T1, the second switching transistor T2 and the driving transistor DT are in a turned-on state. The low-potential signal of the reference signal end Ref is provided for the gate electrode (N1 point) of the driving transistor DT by the turned-on first switching transistor T1, to initialize a potential of the gate electrode (N1 point) of the driving transistor DT; and a potential of the anode of the light emitting device L is decreased by the low-potential signal of the first power supply end VDD, so as to initialize the potential of the anode of the light emitting device L. In the phase, it is assumed that the potential of the N1 point is V1 (Ref is a low-potential signal and is set as 0 V), and a potential of an N2 point is the low-potential signal of the first power supply end VDD.

In the compensation phase T2, EM=1, Gate=1, Data=0, Ref=0 and VDD=1.

Figure 6:
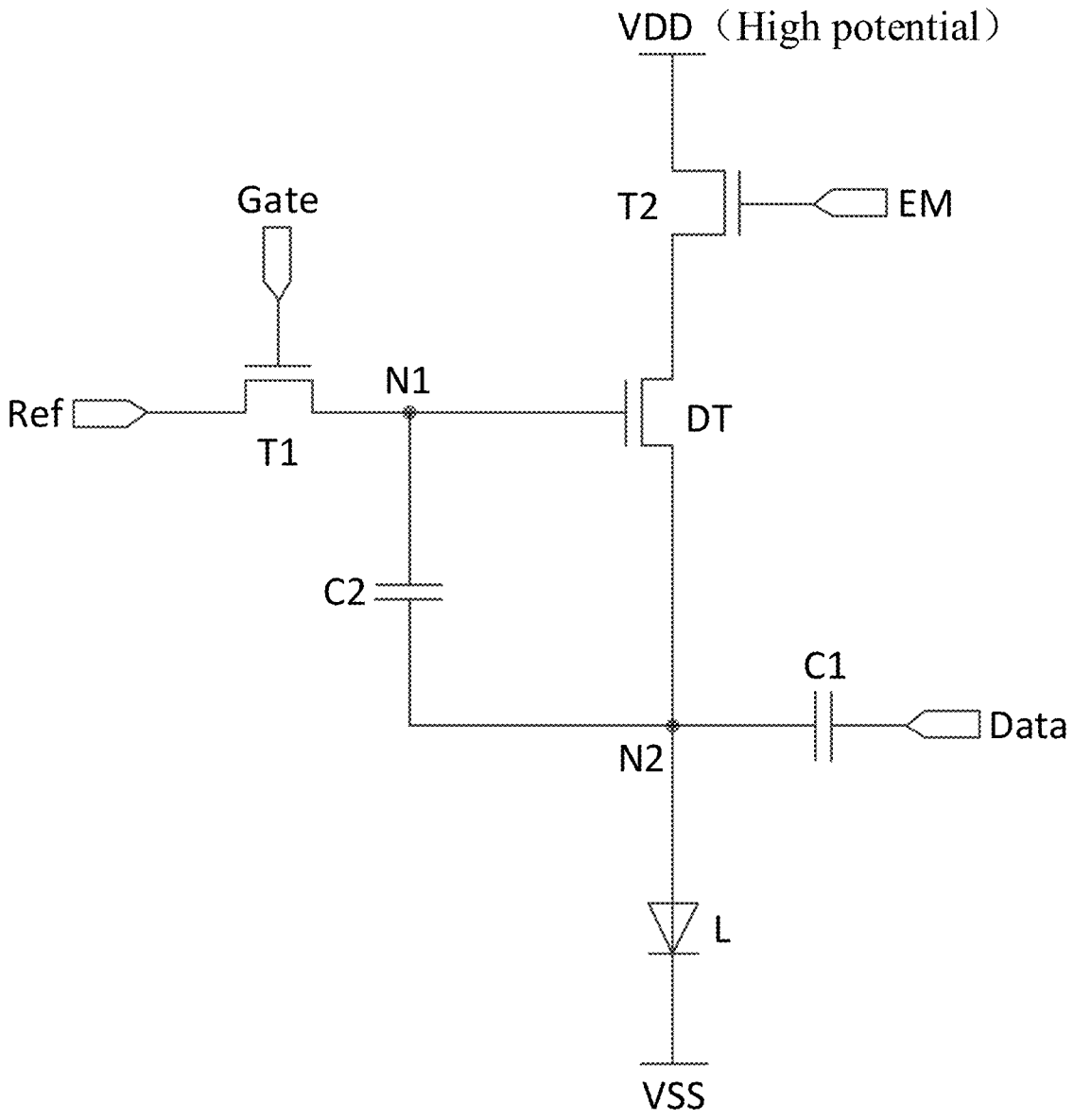
FIG. 6 is a schematic structural diagram of the pixel circuit as shown in FIG. 1 in a compensation phase.

As shown in FIG. 6, illustrating a schematic diagram of a working condition of the compensation phase of the pixel circuit of the present disclosure, all the first switching transistor T1, the second switching transistor T2 and the driving transistor DT are in a turned-on state. The low-potential signal of the reference signal end Ref is still provided for the N1 point by the turned-on first switching transistor T1, and the potential of the N1 point is still V1 (0 V); since VDD=1, a threshold voltage Vth of the driving transistor DT is compensated to the second electrode (N2 point) of the driving transistor DT in the phase, and the potential of the N2 point is V1−Vth.

In the data writing phase T3, EM=0, Gate=1 to 0, Data=1 to 0, Ref=1 and VDD=1.

Figure 7:
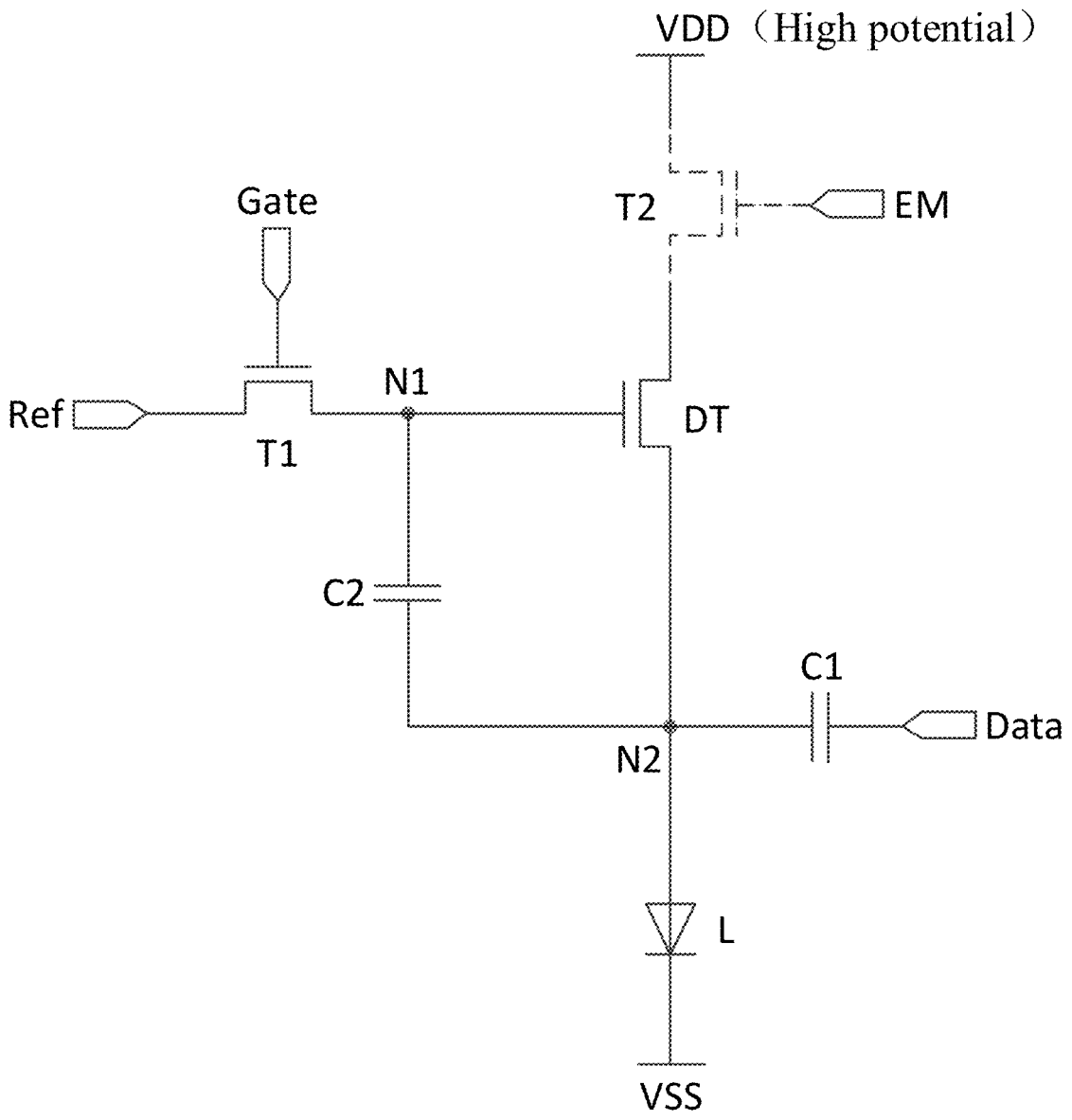
FIG. 7 is a schematic structural diagram of the pixel circuit as shown in FIG. 1 in a data writing phase.

As shown in FIG. 7, illustrating a schematic diagram of a working condition of the data writing phase of the pixel circuit of the present disclosure, the second switching transistor T2 is in a turned-off state, firstly, a signal of the scanning signal end Gate is at a high potential to turn on the first switching transistor T1, the high-potential signal of the reference signal end Ref is provided for the N1 point, and a signal of the data signal end Data is at a high potential to complete writing of the data signal; then, the signal of the scanning signal end Gate is at a low potential to turn off the first switching transistor T1, and after the first switching transistor T1 is turned off, both the signal of the data signal end Data and the signal of the reference signal end Ref become low-potential signals. In the phase, before the signal of the data signal end Data is decreased, the potential of the N1 point is V2 (the high-potential signal of the end Ref), and due to a serial voltage division effect of the first capacitor C1 and the second capacitor C2, the potential of the N2 point is $$\frac{C1}{C1+C2}*(V2-V1)+\frac{C2}{C1+C2}*VData-Vth;$$

since V1=0, a potential difference of the N1 point and the N2 point is $$\frac{C2}{C1+C2}*(V2-VData)+Vth.$$

Since both the N1 point and the N2 point are in a suspension joint state after the first switching transistor T1 is turned off, decrease of the signal of the data signal end Data is incapable of affecting the potential difference of the N1 point and the N2 point.

It is assumed that the threshold voltage of the driving transistor DT is Vth=0, the potential difference of the N1 point and the N2 point is (V2−VData), and the range of a value of a current flowing into the light emitting device L is 1 uA-5 uA, the above-mentioned range of the current value is met when the data signal input to the data signal end Data by the driving IC is 0-3 V in the related art. The driving capability of the driving IC is limited, so that only four data voltages 0 V, 1 V, 2 V and 3 V may be input to the data signal end Data in the related art, input of the four data voltages may ensure that the obtained potential difference of the N1 point and the N2 point is within a preset range, it is ensured that the current flowing into the light emitting device L is effective. The obtained current value is relatively small due to the relatively small range of the data voltages, an OLED display panel is driven by a current, and the current flowing into the light emitting device L may not be controlled at higher precision, so that the display frame is not delicate enough. For the above-mentioned pixel circuit according to the embodiment of the present disclosure, when Vth=0, the potential difference of the N1 point and the N2 point is $$\frac{C2}{C1+C2}*(V2-VData),$$

it may be seen that $$\frac{C2}{C1+C2}<1.$$

If a range of the potential difference of the N1 point and the N2 point, which is same as that in the related art, is expected to be obtained, the data voltage VData of the data signal end Data in the present disclosure may be extended by $$\frac{C1+C2}{C2}$$

times; it is assumed that $$\frac{C2}{C1+C2}=\frac{1}{2},$$

the data voltage VData of the data signal end Data may be doubled, namely the driving IC may input seven data voltages 0 V, 1 V, 2 V, 3 V, 4 V, 5 V and 6 V to the data signal end Data, different current values corresponding to the seven data voltages are all effective current values. Therefore, due to coordination of the first capacitor C1 and the second capacitor C2 in the pixel circuit of the present disclosure, the input range of the data voltage of the data signal end may be extended, more effective currents are achieved, so that the display frame is more delicate; and the extended range is related to the capacitance values of the two capacitors, and therefore, the pixel circuit according to the present disclosure may extend the input range of the data voltage on the basis that the driving capability of the driving IC is not improved, namely the data voltage may have higher precision on the basis that the cost is not increased, so that more precise current control is realized, and the precision of the display frame is improved.

It should be noted that the above-mentioned ranges of the potential difference of the N1 point and the N2 point, ranges of the data voltage and ranges of the current value are merely illustrated, in order to explain that the pixel circuit according to the present disclosure may extend the input range of the data voltage on the basis that the driving capability of the driving IC is not improved, in some embodiments, the ranges of the potential difference of the N1 point and the N2 point, ranges of the data voltage and ranges of the current value may be determined according to an actual demand.

In the light emitting phase T4, EM=1, Gate=0, Data=0, Ref=0 and VDD=1.

Figure 8:
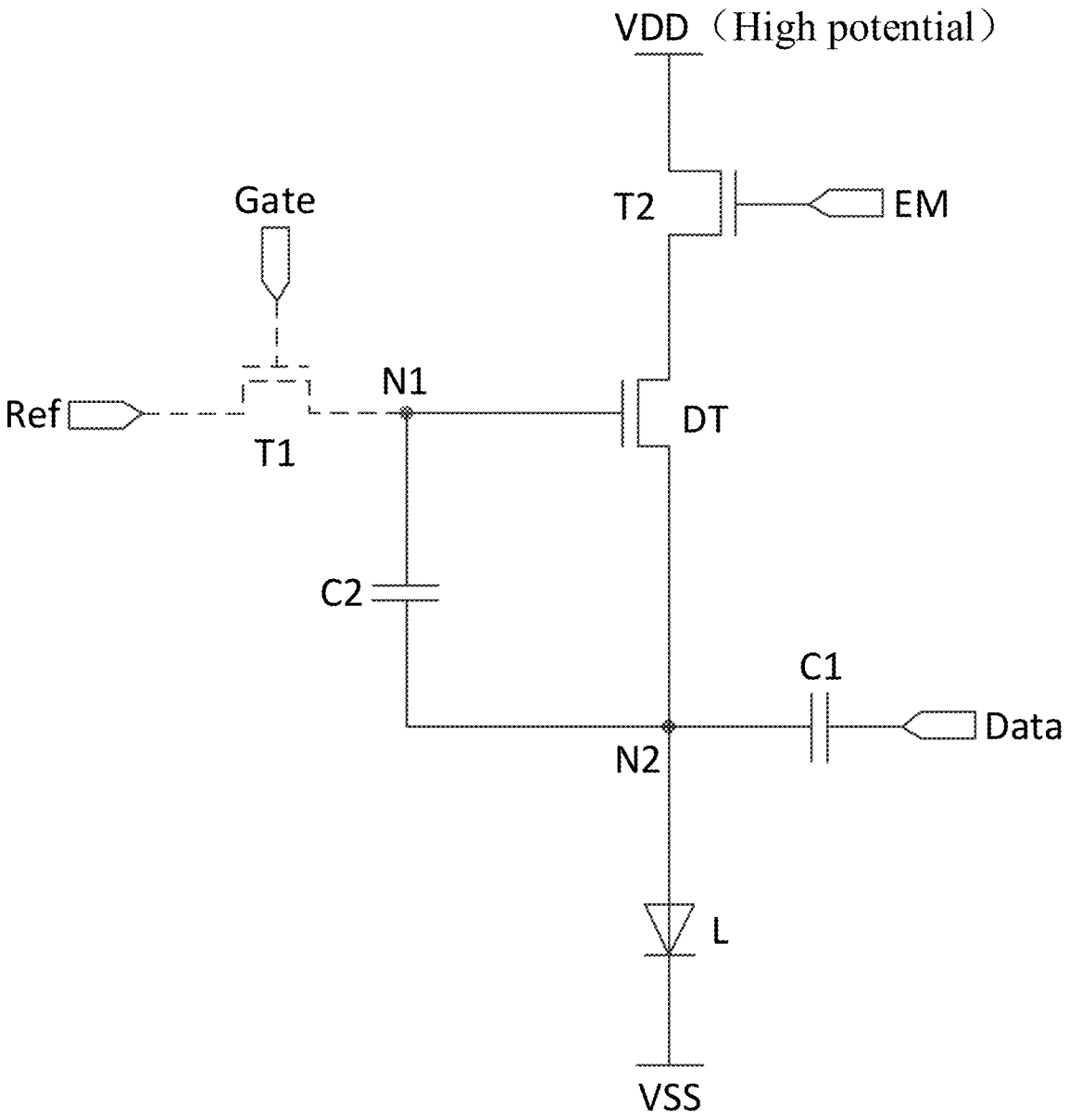
FIG. 8 is a schematic structural diagram of the pixel circuit as shown in FIG. 1 in a light emitting phase.

As shown in FIG. 8, illustrating a schematic diagram of a working condition of the light emitting phase of the pixel circuit of the present disclosure; the first switching transistor T1 is in a turned-off state, both the second switching transistor T2 and the driving transistor DT are in a turned-on state, the voltage of the first electrode of the driving transistor DT is the voltage of the first power supply end VDD, the driving transistor DT works in a saturated state, and known from a current characteristic in the saturated state, a working current $I_{OLED}$ flowing through the driving transistor DT and being used for driving the light emitting device L to emit light meets a formula:

$$\begin{aligned} I_{OLED} &= K(VN1N2-Vth)2 \\ &= K\left(\frac{C2}{C1+C2}*(V2-VData)+Vth-Vth\right)2 \\ &= K\left(\frac{C2}{C1+C2}*(V2-VData)\right)2. \end{aligned}$$

Wherein K is a structural parameter, is relatively stable in the same structure and may be regarded as a constant. Therefore, it may be seen that the working current $I_{OLED}$ of the light emitting device L has not been affected by the threshold voltage Vth of the driving transistor DT and is only related to the data voltage VData of the data signal end Data and the reference voltage V2 of the reference signal end Ref, so that influences of drifting of the threshold voltage Vth of the driving transistor DT on the working current $I_{OLED}$ of the light emitting device L due to technical processes and long-term operation are thoroughly solved, and furthermore, the display non-uniformity of the panel is improved. Moreover, the above-mentioned pixel circuit according to the embodiment of the present disclosure may realize compensation of the threshold voltage Vth of the driving transistor DT by only adopting the three transistors and the two capacitors, so as to be relatively simple in structure.

Figure 9:
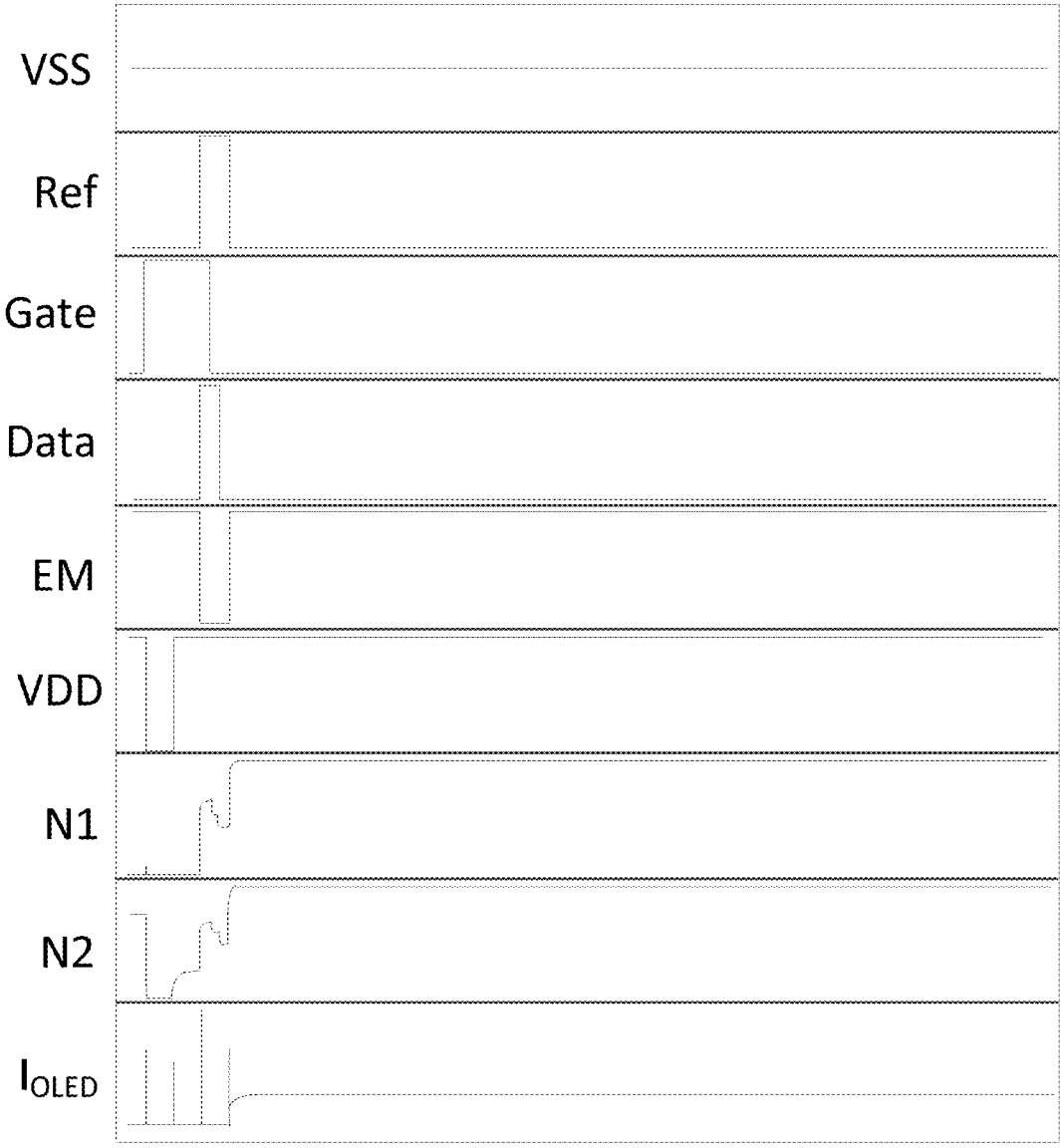
FIG. 9 is a simulation diagram of the pixel circuit according to the embodiment of the present disclosure.

Moreover, in the present disclosure, time sequences of the pixel circuit according to the above-mentioned embodiment in the four phases are further simulated, as shown in FIG. 9. Seen from a simulation result of FIG. 9, the time sequences are basically consistent with the time sequence diagram as shown in FIG. 4, and potentials of the N1 point and the N2 point are also basically consistent, so that it may be verified that the working current $I_{OLED}$ of the light emitting device L is really not affected by the threshold voltage Vth of the driving transistor DT in the pixel circuit according to the embodiment of the present disclosure.

Based on the same inventive concept, an embodiment of the present disclosure further provides a display panel including any one of the above-mentioned pixel circuit according to the embodiment of the present disclosure. A principle of solving problems of the display panel is similar to that of the above-mentioned pixel circuit, and therefore, implementation of the display panel may refer to that of the above-mentioned pixel circuit, repetitions thereof are omitted herein.

In some embodiments, in the above-mentioned display panel according to the embodiment of the present disclosure, the display panel may be an OLED display panel.

Based on the same inventive concept, an embodiment of the present disclosure further provides a display device including the above-mentioned display panel according to the embodiment of the present disclosure. The display device may be any one product or component with a display function, such as a mobile phone, a tablet personal computer, a television, a display, a notebook computer, a digital photo frame and a navigator. Those ordinary skilled in the art should understand that other essential components of the display device are provided, descriptions thereof are omitted herein, and they should not be regarded as limitations on the present disclosure. Implementation of the display device may refer to the embodiment of the above-mentioned pixel circuit, repetitions thereof are omitted herein.

According to the pixel circuit, the method for driving the same, the display panel and the display device according to the embodiments of the present disclosure, the pixel circuit includes the first switching transistor, the second switching transistor, the first capacitor, the second capacitor, the driving transistor and the light emitting device, wherein the gate electrode of the first switching transistor is connected with the scanning signal end, the first electrode of the first switching transistor is connected with the reference signal end, and the second electrode of the first switching transistor is connected with the gate electrode of the driving transistor; the gate electrode of the second switching transistor is connected with the light emitting control signal end, the first electrode of the second switching transistor is connected with the first power supply end, and the second electrode of the second switching transistor is connected with the first electrode of the driving transistor; the first end of the first capacitor is connected with the data signal end, and the second end of the first capacitor is connected with the second electrode of the driving transistor; the first end of the second capacitor is connected with the gate electrode of the driving transistor, and the second end of the second capacitor is connected with the second electrode of the driving transistor; and the anode of the light emitting device is connected with the second electrode of the driving transistor, and the cathode of the light emitting device is connected with the second power supply end. Therefore, by coordination of the above-mentioned three transistors and two capacitors, the input range of the data voltage of the data signal end may be extended, the extended range is related to the capacitance values of the two capacitors, and therefore, the pixel circuit according to the present disclosure may extend the input range of the data voltage on the basis that the driving capability of the driving IC is not improved, namely the data voltage may have a wider input range on the basis that the cost is not increased, so that higher-precision current control is realized, and the precision of the display frame is improved. In addition, by coordination of the above-mentioned three transistors and two capacitors, the current output by the driving transistor in the pixel circuit may also be only related to the data voltage of the data signal end and the reference voltage of the reference signal end, but is unrelated to the threshold voltage of the driving transistor, in this way, influences of the threshold voltage of the driving transistor on the current output by the driving transistor may be avoided, so that the current output by the driving transistor may be kept stable, and furthermore, the brightness uniformity of the frame in the display area in the display device may be improved.

Obviously, those skilled in the art can make various alterations and transformations on the present disclosure without departing from the spirits and scopes of the present disclosure. In this way, if these alterations and transformations of the present disclosure fall within the scope of the claims of the present disclosure and equivalent technologies of the claims, the present disclosure is also intended to include these alterations and transformations.

What is claimed is:

1. A pixel circuit, comprising:

a first switching transistor, a second switching transistor, a first capacitor, a second capacitor, a driving transistor, and a light emitting device;

wherein a gate electrode of the first switching transistor is directly connected with a scanning signal end, a first electrode of the first switching transistor is directly connected with a reference signal end, and a second electrode of the first switching transistor is directly connected with a gate electrode of the driving transistor;

a gate electrode of the second switching transistor is directly connected with a light emitting control signal end, a first electrode of the second switching transistor is directly connected with a first power supply end, and a second electrode of the second switching transistor is directly connected with a first electrode of the driving transistor;

a first end of the first capacitor is directly connected with a data signal end, and a second end of the first capacitor is directly connected with a second electrode of the driving transistor;

a first end of the second capacitor is directly connected with the gate electrode of the driving transistor, and a second end of the second capacitor is directly connected with the second electrode of the driving transistor; and an anode of the light emitting device is directly connected with the second electrode of the driving transistor, and a cathode of the light emitting device is directly connected with a second power supply end.

2. The pixel circuit according to claim 1, wherein a capacitance value of the second capacitor is greater than that of the first capacitor.

3. The pixel circuit according to claim 1, wherein each of the first switching transistor, the second switching transistor and the driving transistor is an N-type transistor.

4. A display panel, comprising the pixel circuit according to claim 1.

5. A display device, comprising the display panel according to claim 4.

6. A method for driving the pixel circuit according to claim 1, comprising:

in a compensation phase: turning on the first switching transistor by the scanning signal end, and loading a low-potential signal to the gate electrode of the driving transistor by the reference signal end; and turning on the second switching transistor by the light emitting control signal end, and loading a high-potential signal to the first electrode of the driving transistor by the first power supply end;

in a data writing phase: turning on the first switching transistor by the scanning signal end, and loading a high-potential signal to the gate electrode of the driving transistor by the reference signal end; turning off the second switching transistor by the light emitting control signal end; and loading a data signal to the second electrode of the driving transistor by the data signal end; and in a light emitting phase: turning off the first switching transistor by the scanning signal end; and turning on the second switching transistor by the light emitting control signal end, and loading the high-potential signal to the first electrode of the driving transistor by the first power supply end, for controlling the driving transistor to drive the light emitting device to emit light.

7. The method according to claim 6, wherein in the data writing phase, time of turning off the first switching transistor by the scanning signal end is earlier than that of stopping loading the data signal by the data signal end.

8. The method according to claim 6, wherein in the data writing phase, time of stopping loading the high-potential signal by the reference signal end is later than that of turning off the first switching transistor by the scanning signal end.

9. The method according to claim 6, wherein in the data writing phase, time of stopping loading the high-potential signal by the reference signal end is later than that of stopping loading the data signal by the data signal end.

10. The method according to claim 6, wherein before the compensation phase, the method further comprises:

in an initialization phase: turning on the first switching transistor by the scanning signal end, and loading the low-potential signal to the gate electrode of the driving transistor by the reference signal end; and turning on the second switching transistor by the light emitting control signal end, and loading the low-potential signal to the first electrode of the driving transistor by the first power supply end.

* * * * *